US008117845B2

(12) United States Patent
Lacy et al.

(10) Patent No.: US 8,117,845 B2
(45) Date of Patent: Feb. 21, 2012

(54) SYSTEMS TO FACILITATE REDUCING FLASHBACK/FLAME HOLDING IN COMBUSTION SYSTEMS

(75) Inventors: Benjamin Paul Lacy, Greer, SC (US); Gilbert Otto Kraemer, Greer, SC (US); Balachandar Varatharajan, Clifton Park, NY (US); Ertan Yilmaz, Albany, NY (US); Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1593 days.

(21) Appl. No.: 11/741,483

(22) Filed: Apr. 27, 2007

(65) Prior Publication Data

US 2009/0320484 A1 Dec. 31, 2009

(51) Int. Cl.
*F02C 1/00* (2006.01)

(52) U.S. Cl. ..... 60/737; 60/748

(58) Field of Classification Search ..... 60/39.091, 60/39.11, 737, 738, 748, 749, 752; 431/354, 431/355

See application file for complete search history.

(56) References Cited

U.S. PATENT DOCUMENTS

| | | | | |
|---|---|---|---|---|
| 3,937,008 | A * | 2/1976 | Markowski et al. | 60/776 |
| 4,173,118 | A * | 11/1979 | Kawaguchi | 60/733 |
| 5,251,447 | A | 10/1993 | Joshi et al. | |
| 5,295,352 | A | 3/1994 | Beebe et al. | |
| 5,321,947 | A | 6/1994 | Sood et al. | |
| 5,345,768 | A | 9/1994 | Washam et al. | |
| 5,408,825 | A | 4/1995 | Foss et al. | |
| 5,640,851 | A | 6/1997 | Toon et al. | |
| 5,718,573 | A | 2/1998 | Knight et al. | |
| 6,094,916 | A | 8/2000 | Puri et al. | |
| 7,086,234 | B2 | 8/2006 | Doerr et al. | |

* cited by examiner

*Primary Examiner* — Louis Casaregola
(74) *Attorney, Agent, or Firm* — Armstrong Teasdale LLP

(57) ABSTRACT

A method for assembling a premixing injector is provided. The method includes providing a centerbody including a center axis and a radially outer surface, and providing an inlet flow conditioner. The inlet flow conditioner includes a radially outer wall, a radially inner wall, and an end wall coupled substantially perpendicularly between the outer wall and the inner wall. Each of the outer wall and the end wall include a plurality of openings defined therein. The outer wall, the inner wall, and the end wall define a first passage therebetween. The method also includes coupling the inlet flow conditioner to the centerbody such that the inlet flow conditioner substantially circumscribes the centerbody, such that the inner wall is substantially parallel to the centerbody outer surface, and such that a second passage is defined between the centerbody outer surface and the inner wall.

15 Claims, 5 Drawing Sheets

SYSTEMS TO FACILITATE REDUCING FLASHBACK/FLAME HOLDING IN COMBUSTION SYSTEMS

STATEMENT REGARDING FEDERALLY SPONSORED RESEARCH & DEVELOPMENT

This invention was made with Government support under DE-FC26-05NT42643 awarded by the Department of Energy ("DOE"). The Government has certain rights in this invention

BACKGROUND OF THE INVENTION

This invention relates generally to combustion systems and more particularly, to methods and systems to facilitate reducing flashback/flame holding in combustion systems.

During the combustion of natural gas and liquid fuels, known lean-premixed combustors generally experience flame holding or flashback in which a pilot flame that is intended to be confined within the combustion liner travels upstream towards the injection locations of fuel and air into the combustion liner. Generally, uniform lean fuel-air mixtures, lower flame temperatures, and/or shorter residence burning time are known to reduce formation of local near stoichiometric zones and lower flow velocity regions in which flashback may occur. At least some known gas turbine combustion systems include premixing injectors that premix fuel and compressed airflow in attempts to channel uniform lean fuel-air premixtures to a combustion liner.

Generally, at least some known premixing injectors include an inlet flow conditioner that conditions compressed airflow in attempts to obtain a substantially uniform airflow to mix with fuel. Such known injectors also generally include a burner tube that channels a fuel-air mixture to a combustor. Non-uniform fuel-air concentrations within the burner tube may enable flame holding or flashback conditions such that a pilot flame that is intended to be confined within the combustion liner travels into the premixing injector. As a result, such injectors may be damaged and/or the operability of the combustor may be compromised.

BRIEF DESCRIPTION OF THE INVENTION

A method for assembling a premixing injector is provided. The method includes providing a centerbody including a center axis and a radially outer surface, and providing an inlet flow conditioner. The inlet flow conditioner includes a radially outer wall, a radially inner wall, and an end wall coupled substantially perpendicularly between the outer wall and the inner wall. Each of the outer wall and the end wall include a plurality of openings defined therein. The outer wall, the inner wall, and the end wall define a first passage therebetween. The method also includes coupling the inlet flow conditioner to the centerbody such that the inlet flow conditioner substantially circumscribes the centerbody, such that the inner wall is substantially parallel to the centerbody outer surface, and such that a second passage is defined between the centerbody outer surface and the inner wall.

A premixing injector is provided. The premixing injector includes a centerbody including a center axis and a radially outer surface. The premixing injector also includes an inlet flow conditioner coupled to the centerbody such that the inlet flow conditioner substantially circumscribes the centerbody. The inlet flow conditioner includes a radially outer wall including a plurality of openings defined therein. The outer wall is oriented substantially parallel to the center axis. The inlet flow conditioner also includes a radially inner wall extending substantially parallel to the outer wall. The inner wall is spaced from the outer wall such that a first passage is defined therebetween. The inner wall is spaced from the centerbody outer surface such that a second passage is defined therebetween. The inlet flow conditioner further includes an end wall extending substantially perpendicularly between the outer and inner walls. The end wall includes a plurality of openings defined therein.

A gas turbine combustor system is provided. The gas turbine system includes a combustion liner and at least one premixing injector coupled to the combustion liner. The at least one premixing injector includes a centerbody including a center axis and a radially outer surface. The at least one premixing injector also includes an inlet flow conditioner coupled to the centerbody such that the inlet flow conditioner substantially circumscribes the centerbody. The inlet flow conditioner includes a radially outer wall including a plurality of openings defined therein. The outer wall is substantially parallel to the center axis. The inlet flow conditioner also includes a radially inner wall extending substantially parallel to the outer wall. The inner wall is spaced from the outer wall such that a first passage is defined therebetween. The inner wall is also spaced from the centerbody outer surface such that a second passage is defined therebetween. The inlet flow conditioner further includes an end wall extending substantially perpendicularly between the outer and inner walls. The end wall includes a plurality of openings defined therein.

DETAILED DESCRIPTION OF THE INVENTION

The exemplary methods and systems described herein overcome the structural disadvantages of known inlet flow conditioners ("IFC") by redesigning an IFC to direct compressed airflow towards local areas of low velocity flow within a burner tube. It should be appreciated that the terms "axial" and "axially" are used throughout this application to refer to directions and orientations extending substantially parallel to a center longitudinal axis of a centerbody of a premixing injector. It should also be appreciated that the terms "radial" and "radially" are used throughout this application to refer to directions and orientations extending substantially perpendicular to a center longitudinal axis of the centerbody. It should also be appreciated that the terms "upstream" and "downstream" are used throughout this application to refer to directions and orientations located in an overall axial fuel flow direction with respect to the center longitudinal axis of the centerbody and/or a combustor case.

Figure 1:
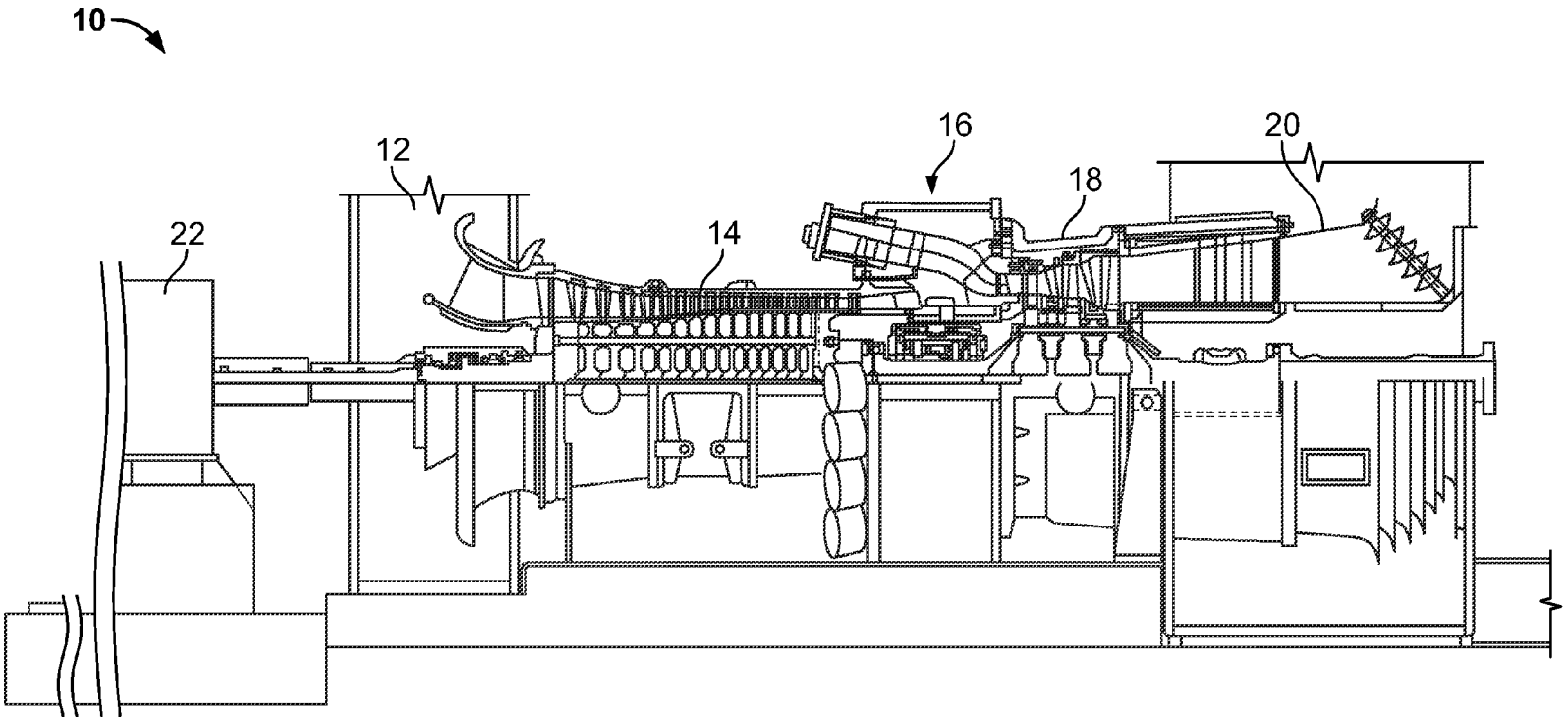
FIG. 1 is a schematic illustration of an exemplary turbine engine assembly including a combustion section.

FIG. 1 is a schematic illustration of an exemplary gas turbine system 10 including an intake section 12, a compressor section 14 downstream from the intake section 12, a combustor section 16 coupled downstream from the intake section 12, a turbine section 18 coupled downstream from the combustor section 16, and an exhaust section 20. Turbine section 18 is rotatably coupled to compressor section 14 and to a load 22 such as, but not limited to, an electrical generator and a mechanical drive application.

During operation, intake section 12 channels air towards compressor section 14. The inlet air is compressed to higher pressures and temperatures. The compressed air is discharged towards combustor section 16 wherein it is mixed with fuel and ignited to generate combustion gases that flow to turbine section 18, which drives compressor section 14 and/or load 22. Exhaust gases exit turbine section 18 and flow through exhaust section 20 to ambient atmosphere.

Figure 2:
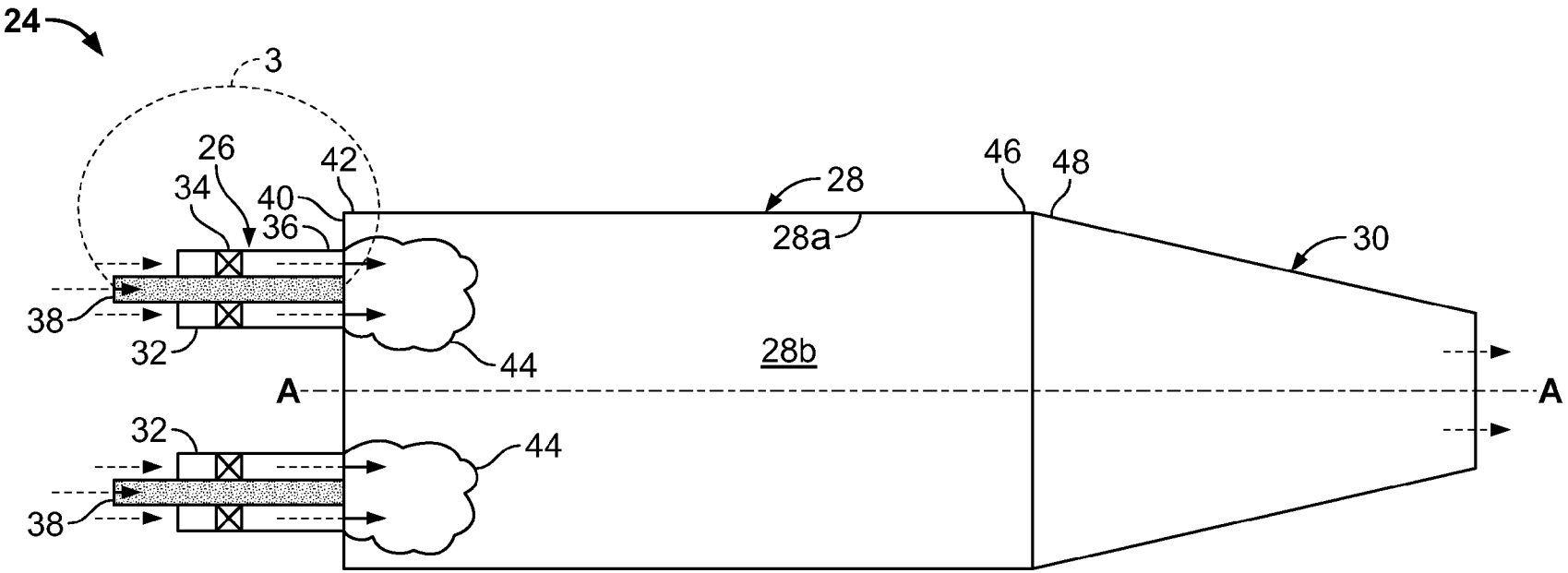
FIG. 2 (Prior Art)
FIG. 2 is a schematic illustration of a cross-sectional view of an exemplary known lean-premixed combustor that may be used with the combustion section shown in FIG. 1.

FIG. 2 is a cross-sectional view of an exemplary known lean-premixed combustor 24 that includes a plurality of premixing injectors 26, a combustion liner 28 having a center axis A-A, and a transition piece 30. Premixing injectors 26 are typically coupled to an end cap 40 of combustor 24 or near a first end 42 of combustion liner 28. Liner first end 42 is coupled to end cap 40 such that combustion liner 28 may receive a fuel-air premixture injected from premixing injectors 26 and burn the mixture in local flame zones 44 defined within combustion chamber 28*b* defined by combustion liner 28. A second end 46 of combustion liner 28 is coupled to a first end 48 of transition piece 30. Transition piece 30 channels the combustion gases to a turbine section, such as turbine section 18 (shown in FIG. 1).

Each premixing injector 26 generally includes an annular inlet flow conditioner ("IFC") 32, an annular swizzle/swirler 34 coupled to IFC 32, and an annular burner tube 36 coupled to swirler 34. Each premixing injector 26 also includes an annular fuel centerbody 38 that is coupled within and coaxial with IFC 32, swirler 34, and burner tube 36. During operation, compressed air enters premixing injectors 26 through IFC 32, which channels the compressed air towards swirler 34. Centerbody 38 channels fuel towards swirler 34. Swirler 34 then premixes the air and fuel, and channels the fuel-air premixture to burner tube 36. Burner tube 36 subsequently channels the fuel-air premixture to combustion liner 28.

Figure 3:
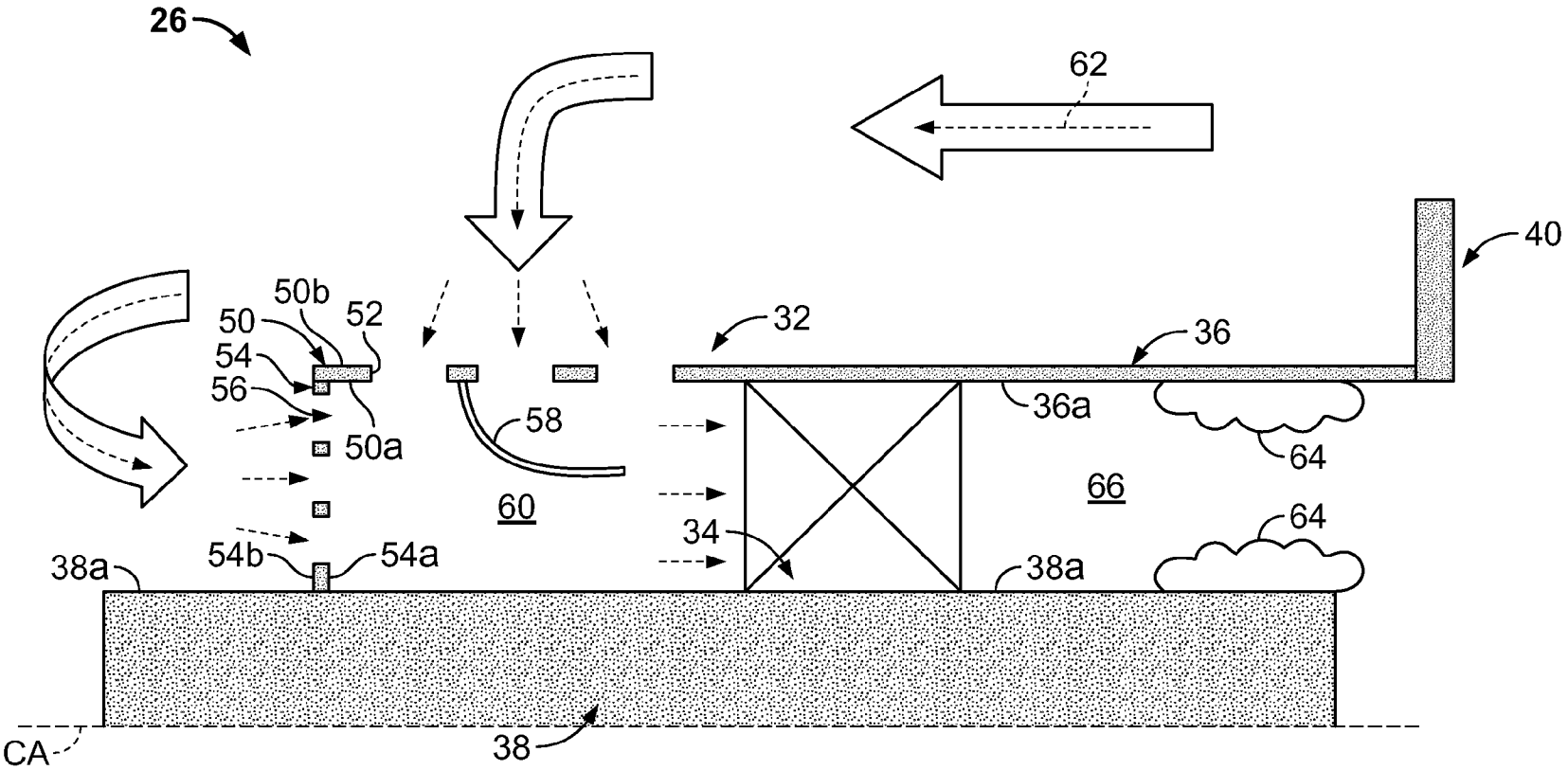
FIG. 3 (Prior Art)
FIG. 3 is an enlarged cross-sectional view of the premixing injector shown in FIG. 2 and taken along area 3.

FIG. 3 is an enlarged cross-sectional view of a portion of known premixing injector 26 taken along area 3. In the exemplary embodiment, known IFC 32 includes a outer wall 50 that defines a plurality of openings 52 between a radially inner surface 50*a* and a radially outer surface 50*b* that are each substantially parallel to a center axis CA of centerbody 38.

IFC 32 also includes an upstream end wall 54 that defines a plurality of openings 56 between a radially inner surface 54*a* and a radially outer surface 54*b* that are each substantially perpendicular to center axis CA. End wall 54 is also coupled between outer wall inner surface 50*a* of and centerbody outer surface 38*a*. Outer wall 50, end wall 54, and centerbody 38 define an annular IFC passage 60 therebetween. IFC 32 further includes an arcuate turning vane 58 that is coupled to inner surface 50*a* within IFC passage 60. Although swirl-based premixing injectors 26 is illustrated as including turning vane 58, it should be appreciated that IFC 32 may include other fuel injection/nozzle concepts.

During operation, compressor 14 channels compressed air 62 towards IFC 32. Compressed air 62 enters IFC 32 through outer wall openings 52 and end wall openings 56. Subsequently, IFC 32 channels air towards swirler 34 to mix with fuel. The fuel-air premixture is then channeled towards burner tube 36.

Because of the orientation and location of openings 52 and 56, airflow distribution within IFC passage 60 is non-uniform. As a result of the non-uniform airflow distribution, air and fuel channeled to swirler 34 do not uniformly mix. The non-uniform fuel-air premixture is channeled towards burner tube 36 in an uneven distribution. Due to boundary layer formation along surfaces, burner local areas of low velocity flow are known to be defined within an annular burner tube passage 66 along burner tube inner surface 36*a*, centerbody outer surface 38*a* and surfaces of vane 58 during operation. The burner local areas of low velocity may define local flame zones 64 where flameholding/flashback may occur. Inadvertent ignition within burner tube 36 could result in flameholding along burner tube inner surface 36*a* where the velocity is low. Alternatively, during operation, a swirling fuel-air mixture is channeled from burner tube 36 towards a larger combustion liner 28.

At the entry into the combustion liner 28, the swirling mixture is known to radially expand in combustion liner 28. The axial velocity at the center of liner 28 is reduced. Such combustor local areas of low turbulent velocity may be below the flame speed for a given fuel-air mixture such as, but not limited to, areas within premixing injectors 26. As such, pilot flames in such areas may flashback towards areas of desirable fuel-air concentrations as far upstream as the low turbulent velocity zone will allow, such as, but not limited to, areas within premixing injectors 26. As a result of such flashback, premixing injectors 26 and/or other combustor components may be damaged and/or operability of combustor 24 may be compromised.

Figure 4:
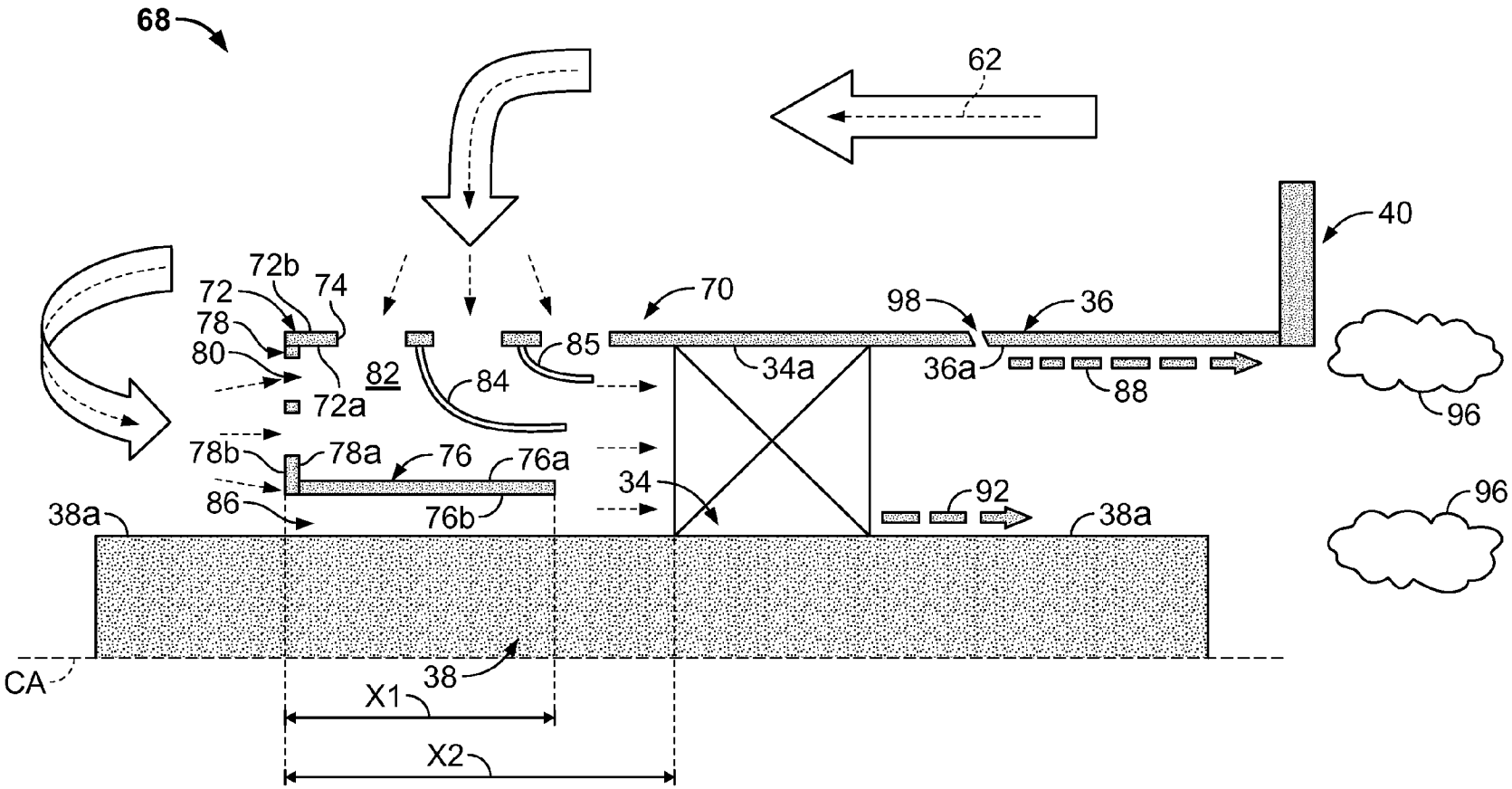
FIG. 4 is an enlarged cross-sectional view of an exemplary premixing injector that may be used with the gas turbine system shown in FIG. 1.

FIG. 4 is an enlarged cross-sectional view of an exemplary premixing injector 68 that may be used with gas turbine system 10 (shown in FIG. 1). Premixing injector 68 includes components that are substantially similar to components of known premixing injector 26 (shown in FIGS. 2 and 3), and components in FIG. 4 that are identical to components of FIGS. 2 and 3, are identified in FIG. 4 using the same reference numerals used in FIGS. 2 and 3.

In the exemplary embodiment, IFC 70 includes an annular outer wall 72 that defines a plurality of openings 74 between a radially inner surface 72*a* and a radially outer surface 72*b* that are each substantially parallel to center axis CA of centerbody 38.

IFC 70 also includes a radially inner wall 76 that is substantially parallel to outer wall 72. Inner wall 76 includes a radially inner surface 76*a* and a radially outer surface 76*b* that are each substantially parallel to center axis CA. IFC 70 further includes an upstream end wall 78 that defines a plurality of openings 80 between a radially inner surface 78*a* and a radially outer surface 78*b* that are each substantially perpendicular to center axis CA. End wall 78 is also coupled between outer wall inner surface 72*a* and inner wall inner surface 76*a*. Outer wall 72, inner wall 76, and end wall 78 define an annular IFC passage 82 therebetween. IFC 70 further includes turning vanes 84 and 85 that are coupled to inner surface 72*a* within IFC passage 82.

When fully assembled, in the exemplary embodiment, IFC 70 is coupled to swirler 34 such that IFC inner wall 76 is radially spaced a distance from centerbody outer surface 38*a*. As such, in addition to IFC passage 82, IFC 70 and centerbody 38 define an annular IFC passage 86 therebetween.

During operation, compressor 14 channels compressed air 62 towards IFC 70. Compressed air 62 enters IFC 70 through outer wall openings 74 and end wall openings 80. Compressed air 62 also enters IFC 70 through IFC passage 86. Because of the orientation and location of turning vane 85 and/or openings 98, airflow within IFC passage 82 is more concentrated and directed along swirler and burner tube inner surfaces 34*a* and 36*a* as compared to the flow directed at the center of the burner tube 36 between inner wall 76 and turning vane 84 and between vanes 84 and turning vane 85. As a result, IFC 70 facilitates distributing more air along inner surface 36*a* of burner tube 36 such that a fuel-air premixture portion 88 is leaner and higher in velocity along inner surfaces 34*a* and 36*a* as compared to known IFCs. As such, IFC 70 facilitates reducing the formation of known local flame zones 64 (shown in FIG. 3) within burner tube 36. IFC 70 also facilitates containing pilot flames 90 within combustion liner 28. It should be appreciated that openings and/or passageways of different shapes and/or locations other than illustrated may be used to facilitate similar directed airflow concentrations as discussed above.

Because of the orientation and location of inner wall 76, airflow within IFC passage 86 is also more concentrated and directed along outer surface 38*a* of centerbody 38 as compared to the flow directed at the center of burner tube 36 between inner wall 76 and turning vane 84 and between vanes 84 and 85. As a result, IFC 70 facilitates distributing more air along outer surface 38*a* of centerbody 38 such that a fuel-air premixture portion 92 is leaner and higher in velocity along outer surface 38*a* as compared to known IFCs. As such, IFC 70 facilitates reducing the formation of known local flame zones 64 (shown in FIG. 3) within burner tube 36. IFC 70 also facilitates containing pilot flames 90 within combustion liner 28. In other words, the inlet air flow turbulence intensity is minimized to facilitate reducing the turbulent flame speed near burner tube surfaces. It should be appreciated that openings and/or passageways of different shapes and/or locations other than illustrated may be used to facilitate similar directed airflow concentrations as discussed above.

Figure 6:
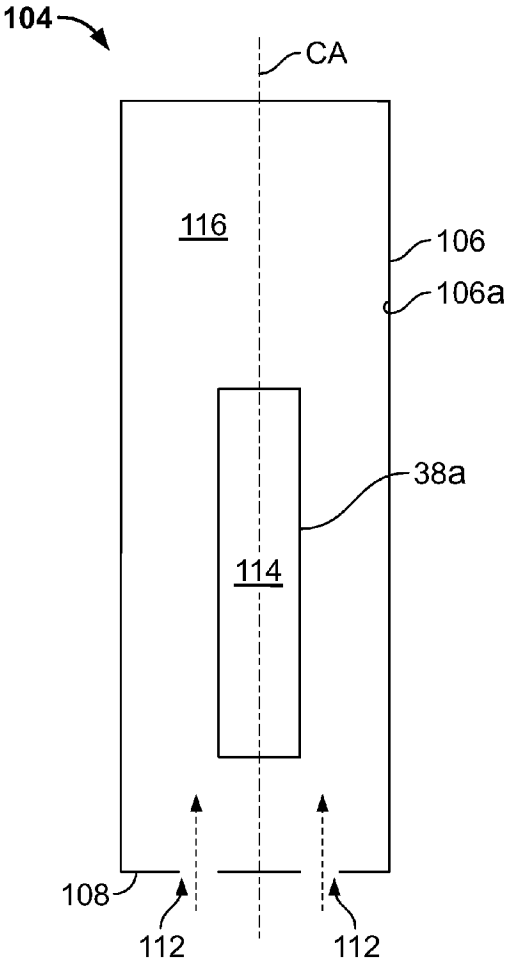
FIG. 6 is a top view of the exemplary premixing injector shown in FIG. 5.
Figure 5:
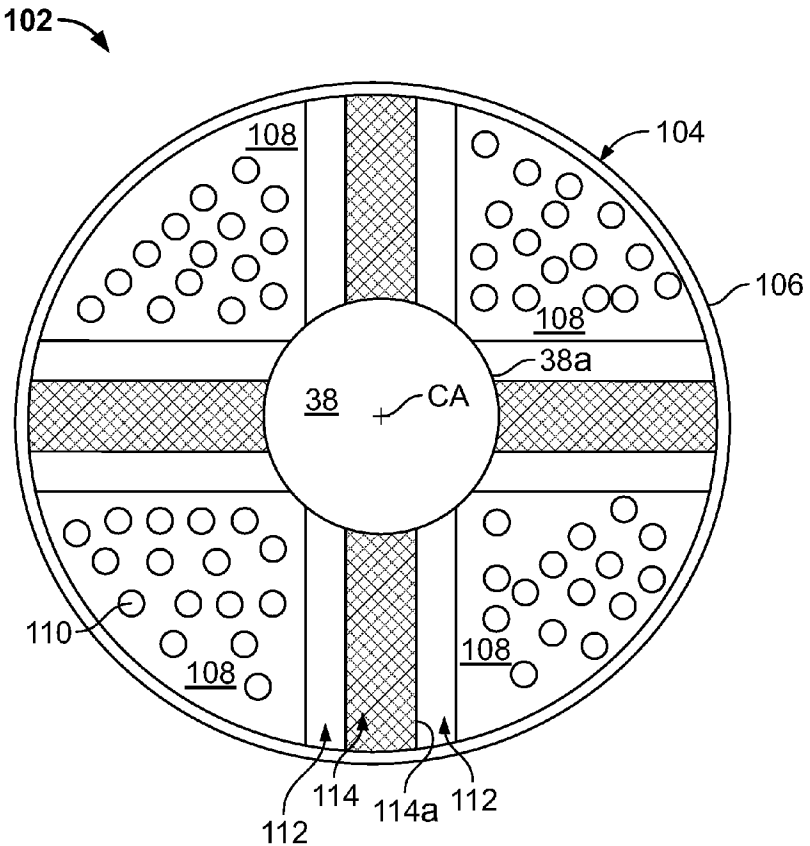
FIG. 5 is an end view of an exemplary premixing injector that may be used with the gas turbine system shown in FIG. 1.

FIG. 5 is an end view of an exemplary premixing injector 102 that may be used with gas turbine system 10 (shown in FIG. 1). FIG. 6 is a top view of premixing injector 102 shown in FIG. 5. Premixing injector 102 includes components that are substantially similar to components of known premixing injector 26 (shown in FIGS. 2 and 3), and components in FIGS. 5 and 6 that are identical to components of FIGS. 2 and 3, are identified in FIGS. 5 and 6 using the same reference numerals used in FIGS. 2 and 3.

In the exemplary embodiment, premixing injector 102 includes IFC 104 having an annular outer wall 106 and an upstream end wall 108. End wall 108 defines a plurality of openings 110 and slots 112. IFC 104 further includes four vanes 114 coupled between outer surface 38*a* of centerbody 38 and coupled within IFC passage 116. During operation, compressor 14 channels compressed air 62 towards IFC 102. Compressed air 62 enters IFC 102 through end wall openings 110 and slots 112.

Because of the larger size and orientation of slots 112 along outer surface 38*a*, airflow within IFC passage 116 is more concentrated and directed along surfaces 114*a* of vanes 114 as compared to outer wall inner surface 106*a*. As a result, IFC 104 facilitates distributing more air along vane surfaces 114*a* such that a fuel-air premixture is leaner and/or higher in velocity along vane surfaces 114*a* as compared to known IFCs. As such, IFC 104 facilitates reducing the formation of known local flame zones 64 (shown in FIG. 3) within burner tube 36. IFC 104 also facilitates containing pilot flames 90 within combustion liner 28. It should be appreciated that openings, slots and/or passageways of different shapes and/or locations other than illustrated may be used to facilitate similar directed airflow concentrations as discussed above.

A method for assembling premixing injector 68 is provided. The method includes providing centerbody 38 including center axis CA and radially outer surface 38*a*. The method also includes providing IFC 70. IFC 70 includes radially outer wall 36, radially inner wall 76, and end wall 78 coupled substantially perpendicularly between outer wall 36 and inner wall 76. Each of outer wall 38 and end wall 78 include a plurality of openings 74 and 80 defined therein. Outer wall 38, inner wall 76, and end wall 78 define first passage 82 therebetween. The method also includes coupling IFC 70 to centerbody 38 such that IFC 70 substantially circumscribes centerbody 38, such that inner wall 76 is substantially parallel to centerbody outer surface 38*a*, and such that second passage 86 is defined between centerbody outer surface 38*a* and inner wall 76.

In each exemplary embodiment, IFCs are oriented and configured to direct compressed airflow along surface of burner tubes and centerbodies of premixing injectors. As a result, higher velocity and leaner fuel-air mixture portions are directed towards known local areas of lower velocity that facilitate formation of local flame zones during operation. The enhanced distribution of airflow facilitates reducing turbulence fluctuations, reducing flashback, reducing component damage, and increasing operability. Although components of the exemplary IFCs have been described as substantially annular, it should be appreciated that the exemplary IFCs may have any shape that enables the exemplary IFCs to function as described above.

Exemplary embodiments of premixing injectors are described in detail above. The premixing injectors are not limited to use with the specified combustors and gas turbine systems described herein, but rather, the premixing injectors can be utilized independently and separately from other combustor and/or gas turbine system components described herein. Moreover, the invention is not limited to the embodiments of the combustors described in detail above. Rather, other variations of injector embodiments may be utilized within the spirit and scope of the claims.

While the invention has been described in terms of various specific embodiments, those skilled in the art will recognize that the invention can be practiced with modification within the spirit and scope of the claims.

What is claimed is:

1. A premixing injector comprising:

a centerbody comprising a center axis and a radially outer surface; and an inlet flow conditioner coupled to said centerbody such that said inlet flow conditioner substantially circumscribes said centerbody, said inlet flow conditioner comprising:

a substantially cylindrical radially outer wall comprising a plurality of openings defined therein, said outer wall is oriented substantially parallel to said center axis;

a radially inner wall extending substantially parallel to said outer wall, said inner wall spaced from said outer wall such that a first passage is defined therebetween, said inner wall spaced from said centerbody outer surface such that a second passage is defined therebetween; and an end wall extending substantially perpendicularly between said outer and inner walls, said end wall comprising a plurality of openings defined therein.

2. A premixing injector in accordance with claim 1 wherein said inlet flow conditioner is configured to distribute compressed airflow along said outer wall inner surface.

3. A premixing injector in accordance with claim 1 wherein said inlet flow conditioner is configured to distribute compressed airflow axially along said centerbody outer surface.

4. A premixing injector in accordance with claim 1 wherein said inlet flow conditioner outer wall, said inner wall, and said end wall are annular.

5. A premixing injector in accordance with claim 1 wherein said inlet flow conditioner is configured to distribute compressed airflow axially along vane surfaces.

6. A premixing injector in accordance with claim 1 further comprising an arcuate vane coupled to said outer wall, said vane is within said first passage.

7. A premixing injector in accordance with claim 1 further comprising a swirler coupled in flow communication with said inlet flow conditioner.

8. A premixing injector in accordance with claim 7 further comprising a burner tube coupled in flow communication with said swirler.

9. A gas turbine combustor system comprising:

a combustion liner; and at least one premixing injector coupled to said combustion liner, said at least one premixing injector comprising:

a centerbody comprising a center axis and a radially outer surface;

an inlet flow conditioner coupled to said centerbody such that said inlet flow conditioner substantially circumscribes said centerbody, said inlet flow conditioner comprising:

a radially outer wall comprising a plurality of openings defined therein, said outer wall is substantially parallel to said center axis;

a radially inner wall extending substantially parallel to said outer wall, said inner wall spaced from said outer wall such that a first passage is defined therebetween, said inner wall spaced from said centerbody outer surface such that a second passage is defined therebetween; and an end wall extending substantially perpendicularly between said outer and inner walls, said end wall comprising a plurality of openings defined therein.

10. A gas turbine combustor system in accordance with claim 9 wherein said inlet flow conditioner is configured to distribute compressed airflow along said outer wall inner surface.

11. A gas turbine combustor system in accordance with claim 9 wherein said inlet flow conditioner is configured to distribute compressed airflow axially along said centerbody outer surface.

12. A gas turbine combustor system in accordance with claim 9 wherein said inlet flow conditioner is configured to distribute compressed airflow axially along vane surfaces.

13. A gas turbine combustor system in accordance with claim 9 further comprising an arcuate vane coupled to said outer wall, said vane is within said first passage.

14. A gas turbine combustor system in accordance with claim 9 further comprising a swirler coupled in flow communication with said inlet flow conditioner.

15. A gas turbine combustor system in accordance with claim 9 further comprising a burner tube coupled in flow communication with said swirler and said combustion liner.

* * * * *